United States Patent [19]

Keller

[11] Patent Number: 4,561,937

[45] Date of Patent: Dec. 31, 1985

[54] APPARATUS FOR TRIMMING THE EDGE OF A WEB DURING FORMATION USING A DRAINAGE INTERRUPTING MASK

[75] Inventor: Martin B. Keller, Hudson Falls, N.Y.

[73] Assignee: Sandy Hill Corporation, Hudson Falls, N.Y.

[21] Appl. No.: 519,116

[22] Filed: Aug. 1, 1983

[51] Int. Cl.[4] ..... D21C 11/02; D21G 9/00

[52] U.S. Cl. ..... 162/286; 162/310; 162/312; 162/351

[58] Field of Search ..... 162/353, 286, 366, 310, 162/306, 312, 195, 194, 260, 351

[56] References Cited

U.S. PATENT DOCUMENTS

| | | | |
|---|---|---|---|
| 3,361,620 | 1/1968 | Gedemer | 162/353 |
| 3,405,031 | 10/1968 | Sisson | 162/310 |
| 3,428,521 | 2/1969 | Roy et al. | 162/366 |
| 3,791,919 | 2/1974 | Schuller et al. | 162/353 |
| 4,315,799 | 2/1982 | Turek et al. | 162/366 |

*Primary Examiner*—Steve Alvo

*Attorney, Agent, or Firm*—Ross, Ross & Flavin

[57] ABSTRACT

In a papermaking machine, a drainage interrupting mask of a certain width is disposed between a continuously moving endless Fourdrinier wire and respective suction box therebelow for interrupting web formation through the said certain width and along the length of the forming web and providing a dividing of the web with that portion of the web outboard of the mask being recycled for subsequent reuse as pulp slurry while the remainder of the forming web continues forwardly for the usual papermaking functions.

2 Claims, 3 Drawing Figures

APPARATUS FOR TRIMMING THE EDGE OF A WEB DURING FORMATION USING A DRAINAGE INTERRUPTING MASK

BACKGROUND OF THE INVENTION

The present invention relates generally to an apparatus for making a non-woven web from fibers of substantial length (say from ½" to 3½") and/or from synthetic fibers, and more particularly to a subassembly for trimming the edge of one or both edges of the web during its formation stage.

With the advent of synthetic fibrids adaptable for use in the art of forming sheet-like structures, as distinguished from the common wood pulps, it has been determined that the dispersion problem now dictates techniques different from those normally used in order to insure optimum operating performance at the forming area and to provide for the desired balance of physical properties in the final product.

Long fibers offer one particularly annoying problem in that they cannot be wet trimmed by the conventional and known means. Trim showers produce ragged or feather edges which offer a tendency to cause breaks.

In this prior art apparatus, it has been traditional to employ trim squirts or wet trim rolls for the purpose of trimming the edge of edges of the formed web in order to best attain a web of the desired width, with the trimmed edge or edges being reverted to recycling processes.

As the art of papermaking machines, has developed and is developing, with pickup and transfer fabrics being employed, it has been obvious that, therewith, with the resultant absence of open draws, the known trim devices are no longer practical for use.

SUMMARY OF THE INVENTION

The present invention stems from the conclusion that, if it is possible to accommodate a so-called trim board configured to cover the length of the forming area and placed beneath the forming wire, it should be possible to interrupt and prevent sheet formation along that length. Thus it should be possible to define what would be called a "split mat" with the main body portion of the forming web being split or separated from the edge portion thereof at the edge or edges thereof.

Of course, the trim board arrangement would be made adjustable in the across-the-machine direction so as to vary the width of the forming web or vary the width of the trimmed edge, as preferred, and, if desired, the arrangement would be disposed at each opposite side of the machine so as to trim both edges of the forming web or at one side of the machine so as to trim but one edge of the forming web.

By way of exemplification, assume a trim board width on the order of 2" and further assume a disposition of that trim board 10" away from the inside headbox wall. Such would allow an edge mat of approximately 10" width which can be disposed of by running same into the couch pit for recycling while the main portion of the forming web continues in its progress for eventual transfer to the next following machine section.

It is significant that by not forming for a certain width along the length of the trim board area, the flow is not disrupted so as to upset look-through, tensile ratio, or other sheet properties.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 3:
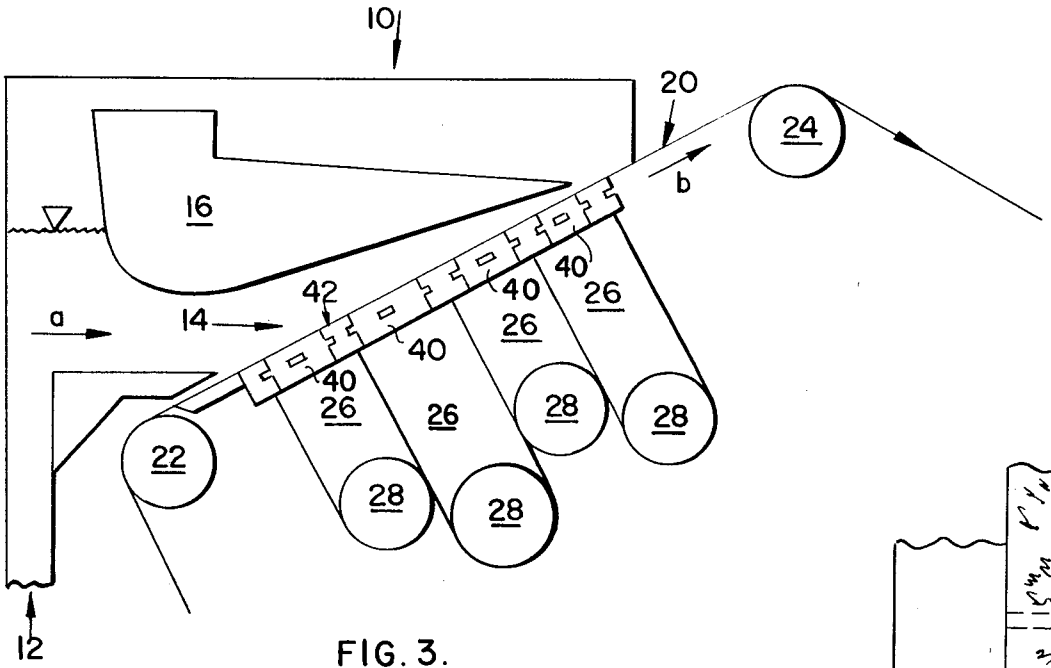
FIG. 3 is a fragmentary diagrammatic sectional view of the left side of the wire section shown in FIG. 1.

Referring firstly to the embodiment as illustrated in FIG. 3, it will be seen that reference numeral 10 identifies a receptacle conventionally known as a headbox having an inlet 12 and an outlet 14 spaced from and forwardly of the inlet.

The inlet 12 is connected in known manner via a supply conduit (not illustrated) with a source of an aqueous suspension of synthetic fibers, for instance glass fibers.

As indicated by arrow a, this suspension flows forwardly in the direction of the arrow and through the outlet 14.

A pond regulator 16 such as identified in my U.S. Pat. No. 3,384,537 serves the function of controlling the flow of the suspension. The pond regulator cooperantly with the headbox walls defines an area therewithin in which the stream of liquid slurry is confined and aids in the control of the discharge of the slurry onto the upwardly-inclined run of the forming wire or screen 20. Means are provided for adjusting the position of the pond regulator with respect to the headbox and of course to the forming wire, but same are not part of this invention and are not shown in detail.

Suffice to say that the pond regulator facilitates the accommodation within the headbox of a large volume of a free-draining aqueous suspension of fibers known as a slurry or pond and designed to allow regulation of the linear velocity of the slurry without permitting loss of the turbulence required to attain optimum dispersion thereof, all so as to achieve herewith the laying down of a layer of stock upon an upwardly-travelling inclined section of the forwardly-moving run of the wire.

Figure 1:
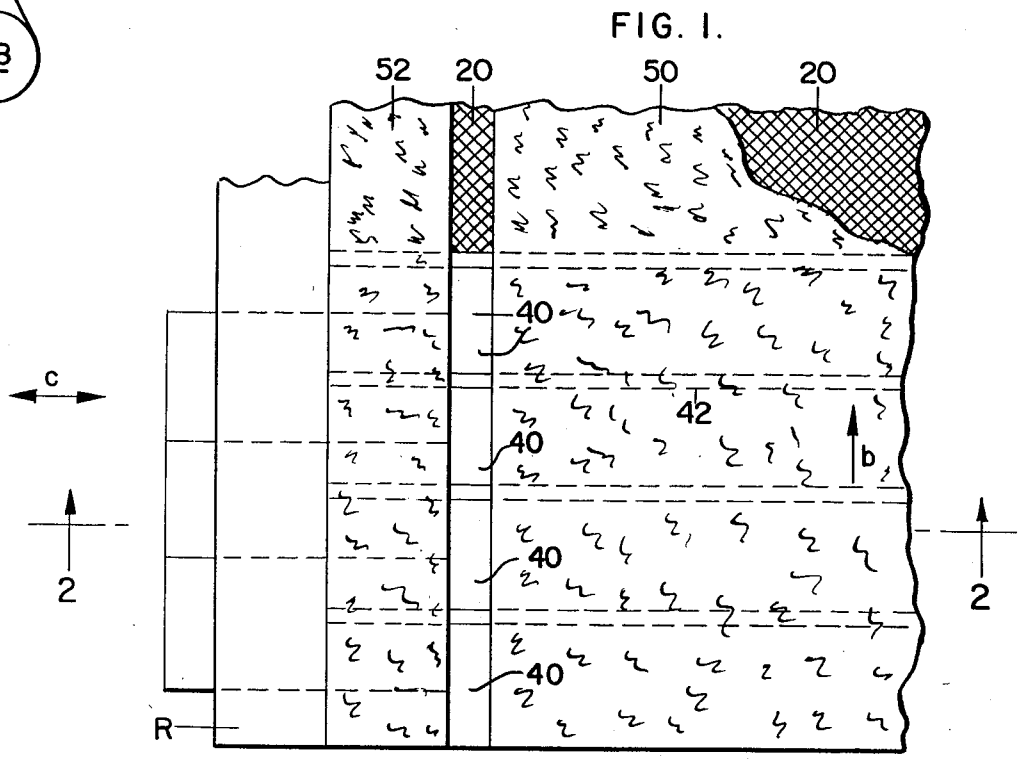
FIG. 1 is a fragmentary diagrammatic view in top plan of the left side of the inclined wire section of the forming machine with the headbox removed and with certain portion of the forming wire removed for purposes of clarity.

Extending across the outlet 14 is the inclined section of an endless forming wire 20 which is entrained about transporting rollers such as 22, 24 et al. Additional non-illustrated rollers may be provided, certain of which may be driven in order for the forming wire to travel in clockwise direction, as viewed in FIG. 1, and as indicated by arrow b.

The term "forming wire" identifies the screen-like belt or the like which is water permeable.

Arranged beneath that inclined run of the forming wire 20 which extends across the outlet 14 are a series of suction boxes 26 or other suction devices which are each provided with outlet conduits 28 wherefor the degree of vacuum along various parts of the run may be controlled.

As the suspension issues from the outlet 14, the aqueous component of the suspension runs off through the forming wire 20, aided by the suction which exists beneath the latter, and this water is then carried away via the conduits 28 for the usual recycling portion of the stock preparation program.

The solid component of the suspension, that is the fibers, becomes deposited on the upper surface of the forming wire to form the non-woven fibrous web, that is a fleece-like mat 30 which travels away from the outlet 14 on the advancing inclined run of the forming wire 20 and is largely freed of water due to the suction effect of the suction boxes 26.

The trim device constitutes a drainage control unit and is constituted into as many spaced trim boards or masks 40 as practical to accommodate to the particular length of the forming area of the papermaking machine upon which installation is made.

The trim boards or masks, while individually and selectively movable, will be arranged in echelon so as to be aligned with each other in the direction of the advance of the forming wire.

The trim boards 40, each of a width in the order of say 2", are disposed beneath the forming wire, and are alignable as to each other in the direction of the advance of the forming wire. Adjacent trim boards are separated by a key 42 extending transversely across the machine width, the trim boards being mated with the respective keys in such as a tongue-and-groove manner wherefor the trim boards may be moved inwardly or outwardly relative to the tending side of the machine in directions as indicated by arrows c.

Each keyway is disposed immediately above a respective line of joinder between respective adjacent suction devices.

In practice the trim boards will be arranged at the desired distance inboard of the inside wall 11 of the headbox 10.

Figure 2:
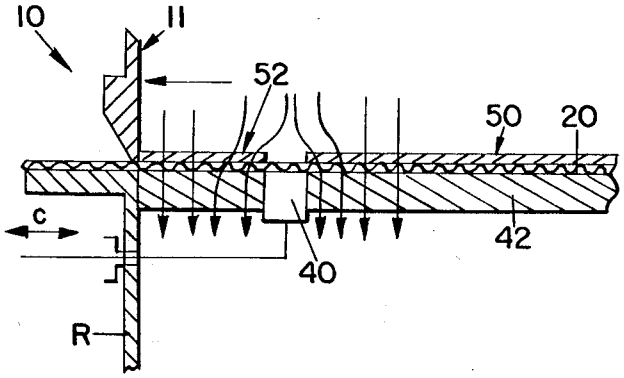
FIG. 2 is a sectional view on the line 2—2 of FIG. 1 and including a schematic fragmentary showing of the respective left side wall of the headbox.

As can be appreciated by reference to FIG. 2, the trim boards can be moved laterally toward or away from the table rail R of the papermaking machine.

The trim boards function in the manner of sliding valves so that the suspension on the wire may be held back from flowing through the wire along the defined length and thereby not only stop its flow through the wire but also preclude the deposition of fibers along that length.

The term trim is normally used to mean cut, but in papermaking the term trim is used to mean separating an edging from a main body portion of a web being formed. Cutting in such instance is not involved.

By the aligning of the trim boards along the axis of the movement of the wire, a width of, in the described exemplification, 2" along the entire mat forming length is provided, in which width drainage through the wire is precluded wherefor disposition of fibers is precluded. Mat formation being there prevented, a split mat is provided with a main portion 50 proceeding forwardly in the usual manner and the split of edge portion 52 proceeding to the recycling system.

From the foregoing it will be understood that the present invention is possessed of unique advantages. However, such modifications and equivalents of the disclosed concepts such as readily occur to those skilled in the art are intended to be included within the scope of this invention and thus the scope of this invention is intended to be limited only by the scope of the claims such as are, or may hereafter be, appended hereto.

The embodiments of the invention in which an exclusive property or privilege is claimed are defined as follows:

1. In a Fourdrinier machine for forming a web from a pulp slurry upon a driven endless foraminous wire having a certain longitudinal axis of movement of the type including an upwardly-inclined run of the wire defining a web-forming surface and a headbox for discharging the slurry onto the upwardly-inclined run and a plurality of adjacent suction devices in stepped relationship as to each other and disposed transversely of and beneath the ascending run; the improvement in a drainage control subassembly positionable at one side of the machine width within the web-forming area and comprising:

a plurality of spaced keys each extending transversely across the machine width within the web-forming area immediately beneath the wire and above a respective line of joinder between respective adjacent suction devices, a plurality of masks each being adjustably movable laterally relative to the longitudinal axis of wire movement and interdigitated with respective adjacent keys at one side of the machine for restricting the area of contact of the vacuum from a respective suction device with the slurry on the web-forming surface immediately thereabove, the keys and masks being arranged with tongue and groove configurations for the sliding movement of each mask relative to each respective pair of keys, the masks of the plurality thereof being arranged in parallelism in alignment with the longitudinal axis of wire movement in delineating a strip having a width corresponding to the width of the masks and disposed at a distance inboard of the side edge of the wire according to the preselected positioning of the masks relative to the wire, the strip defining an area longitudinally of and below the forming web whereat drainage is precluded so as to divide the forming web into a main body portion and a side edge trim portion at opposite sides of the strip.

2. In a Fourdrinier machine for forming a web from a pulp slurry upon a driven endless foraminous wire having a certain longitudinal axis of movement of the type including an upwardly-inclined run of the wire defining a web-forming surface and a headbox for discharging the slurry onto the upwardly-inclined run and a plurality of adjacent suction devices in stepped relationship as to each other and disposed transversely of and beneath the ascending run; the improvement in a drainage control subassembly positionable at opposite sides of the machine width within the web-forming area and comprising:

a plurality of spaced keys each extending transversely across the machine width within the web-forming area immediately beneath the wire and above a respective line of joinder between respective adjacent suction devices, a plurality of masks each being adjustably movable laterally relative to the longitudinal axis of wire movement and interdigitated with respective adjacent keys at each side of the machine for restricting the area of contact of the vacuum from a respective suction device with the slurry on the web-forming surface immediately thereabove, the keys and masks being arranged with tongue and groove configurations for the sliding movement of each mask relative to each respective pair of keys, the masks of the plurality thereof at each side being arranged in parallelism in alignment with the longitudinal axis of wire movement in delineating at each side a strip having a width corresponding to the widths of the masks and disposed at a distance inboard of the respective side edge of the wire according to the preselected positioning of the masks relative to the wire, the strips defining areas longitudinally of and below the forming web whereat drainage is precluded so as to divide the forming web into a main body portion and side edge trim portion at the respective opposite sides of the strips.

* * * * *